United States Patent [19]

Chadshay

[11] Patent Number: 4,459,922

[45] Date of Patent: Jul. 17, 1984

[54] EXTERNALLY ADJUSTABLE PIPE ORIFICE ASSEMBLY

[75] Inventor: Roman Chadshay, Windsor, Conn.

[73] Assignee: Combustion Engineering, Inc., Windsor, Conn.

[21] Appl. No.: 460,222

[22] Filed: Jan. 24, 1983

[51] Int. Cl.[3] ..... F23D 1/00

[52] U.S. Cl. ..... 110/265; 251/212; 251/8; 110/263

[58] Field of Search ..... 110/263, 347, 265, 261, 110/106; 251/8, 212; 138/45, 46

[56] References Cited

U.S. PATENT DOCUMENTS

| | | | |
|---|---|---|---|
| 3,102,710 | 9/1963 | Dresden | 251/212 |
| 3,584,830 | 6/1971 | Koehn | 251/8 |
| 3,626,497 | 12/1971 | Lambert | 251/8 |
| 3,787,022 | 1/1974 | Wilcox | 251/212 |
| 4,092,010 | 5/1978 | Carlson, Jr. | 251/212 |
| 4,094,492 | 6/1978 | Beeman et al. | 251/212 |
| 4,150,631 | 4/1979 | Frey et al. | 110/265 |
| 4,232,595 | 11/1980 | Cox | 251/212 |
| 4,300,749 | 11/1981 | Ferro et al. | 138/45 |

*Primary Examiner*—Henry C. Yuen

*Attorney, Agent, or Firm*—Arthur L. Wade

[57] ABSTRACT

A coal pulverizer is connected to the burner nozzles of a tangentially-fired furnace with conduits of varying lengths through which air-entrained coal is supplied for combustion within the furnace. An externally adjustable orifice assembly is mounted in each connecting conduit to equalize the flow of coal/air through the conduits to nozzles in the windboxes. Each orifice assembly comprises pivotable plates which move transverse the axis of the conduit to form an orifice in controlling the coal/air flow.

1 Claim, 3 Drawing Figures

EXTERNALLY ADJUSTABLE PIPE ORIFICE ASSEMBLY

TECHNICAL FIELD

The present invention relates to the control of airentrained coal flowing from the pulverizer to the fuel nozzles which are mounted in the windboxes of a tangentially-fired furnace. More particularly, the invention relates to a form of orifice mounted as a restriction in each conduit through which pulverized coal is delivered from the pulverizer to a fuel nozzle.

BACKGROUND ART

Flowing air-entrained pulverized coal from the pulverizer to the fuel nozzles offers a distinctive challenge to control. Tangentially-fired, pulverized coal furnaces must have their separate supplies of pulverized fuel to the nozzles in their windboxes adjusted to tune and balance the fireball their combustion generates within the combustion chamber of the furnace. Therefore, some means of equalizing the coal flow to each fuel nozzle must be provided.

Of course, some forms of valve in the conduits between the pulverizer and the fuel nozzles must be provided. Essentially, this valve structure is a restriction to flow. However, it cannot be emphasized too strongly that the movable restricting elements of any valve structure are subject to the abrasion by hard coal particles. Those skilled in the art are acutely aware that pulverized coal, hurtled by high velocity air entraining the particles, erode surfaces which restrict their flow and clog any movable mechanisms provided to adjust the position of restricting valve elements.

In this severe duty, it has been customary to mount orifice plates in the conduits between the pulverizer and the fuel nozzles. Empirically, the size of the orifice in each conduit is determined to attain the balance between the flows to the various nozzles. It is the present general practice to form fixed plates of cast iron, although Ni-hard is sometimes used. The use of this material has resulted in its relatively rapid deterioration, enlarging the orifice and unbalancing the flows. When this deterioration progresses to an unacceptable level, it is necessary to change the orifice plate by shutting down the operation for the time required to make the change. This interruption of pulverized coal flow is unsatisfactory, bordering on the unacceptable. Some form of externally adjustable orifice must be provided so that an operator can regain the desired degree of restriction to pulverized coal flow when that coal flow has eroded the orifice structure and enlarged the orifice opening to an unacceptable limit.

DISCLOSURE OF THE INVENTION

The present invention contemplates a plurality of plate segments pivotably mounted in a bracket, which bracket is fastened between two conduit sections through which air-entrained pulverized coal flows, the segments being pivoted by an operator from external the conduit.

The invention further contemplates plate segments formed of silicon carbide (or other suitable abrasion-resistant material) being pivoted eccentrically from a bracket mounted between conduit sections, the degree of eccentric pivoting controlled by screw members mounted on the bracket and operated from external the conduit sections to determine the amount of the plate section inserted into the path of pulverized coal flowing through the conduit sections.

Other objects, advantages and features of this invention will become apparent to one skilled in the art upon consideration of the written specification, appended claims, and attached drawings.

BRIEF DESIGNATION OF THE DRAWINGS

TERMINOLOGY

Conduit will refer to the conveying means with which to connect the disclosed coal pulverizer to the fuel nozzles of the furnace windboxes. Each connection, as a conduit, can be restricted in its cross section by a structure embodying the present invention.

A restricting structure for a conduit may be generally referred to as a valve, in that the structure has a movable element, or elements, which determine the size of cross-sectional area of the conduit in which it is mounted. Insofar as the movable elements of the valve structure are pivoted inward to form a roughly uniform opening of variable diameter, the structure mat be referred to as an orifice. Therefore, for the purposes of the present disclosure, orifice and valve will be used as equivalent terms.

The movable elements of the valve/orifice structure of the present invention are referred to as plate segments. A plurality of these plate segments are individually pivoted from near one of their ends, and, for that reason, are described as being eccentrically pivoted. As the place segments pivot more or less uniformly transverse the axis of their conduit, they may be linked unto the cooperating leaves of a camer shutter.

BEST MODE FOR CARRYING OUT THE INVENTION

Control To Each Windbox

Figure 1:
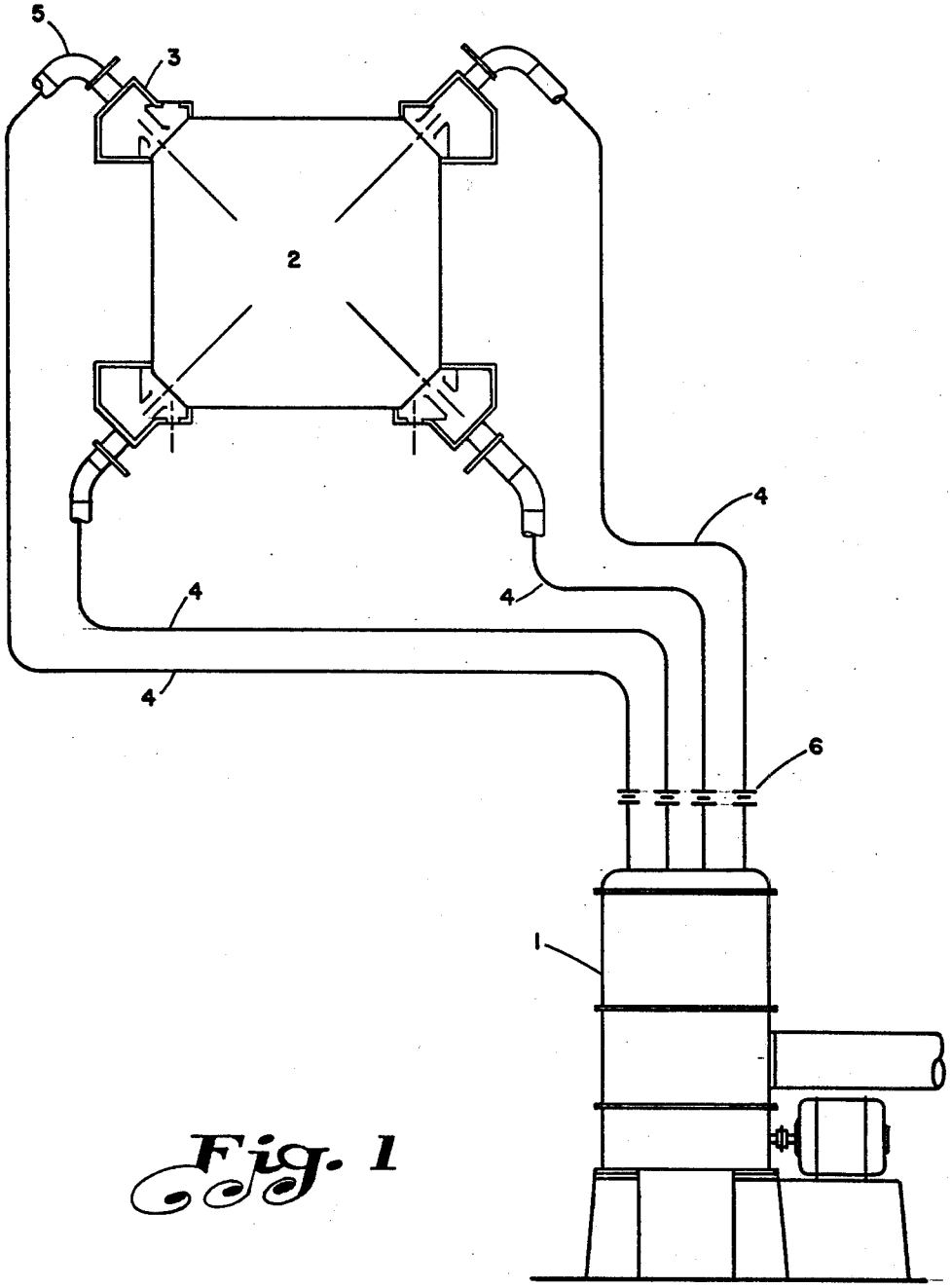
FIG. 1 is an elevation of a coal pulverizer connected to supply a plurality of fuel nozzles in the windboxes of a tangentially-fired furnace wherein the connections are restricted by orifices embodying the present invention.

FIG. 1 discloses a coal pulverizer 1 connected to supply pulverized coal to a furnace 2. Specifically, windboxes 3 in each corner of the combustion chamber of furnace 2 are each connected to pulverizer 1 by a separate conduit. Conduits 4 convey air-entrained pulverized coal to the fuel nozzles 5 of windboxes 3. Also, orifice or valve structures 6 are mounted in conduits 4 to establish the rate at which air-entrained pulverized coal is delivered to the fuel nozzles 5 in the windboxes 3. All of these conduits have similar restrictive structures and individual adjustment of each restrictive structure enables an operator to establish the characteristics of the fireball propagated by the burners in the windboxes of furnace 2. Usually, the operator strives to obtain equality of flow through all the conduits 4.

It is the old practice in the art to provide a fixed orifice plate in conduits 4. Obviously, this old practice necessitated a changeout operation only when the furnace was shut down. Further, the use of fixed orifices did not provide the flexibility of adjustment during furnace operation, and individual adjustment of the restriction in each conduit is very important to refine the shape and combustion conditions of the fireball within the furnace chamber. Also, when the inevitable wear of the orifice occurred, the orifice plates in each conduit usually did not deteriorate uniformly. Coordinating the throughputs of all the conduits was precluded during furnace operation. In summation, under the old practice, fixed orifice plates gave only initial, approximately equal throughputs in the conduits and no opportunity to make further regulating adjustments during furnace operation. The present invention solves this problem.

Segmented Orifice

Figure 2:
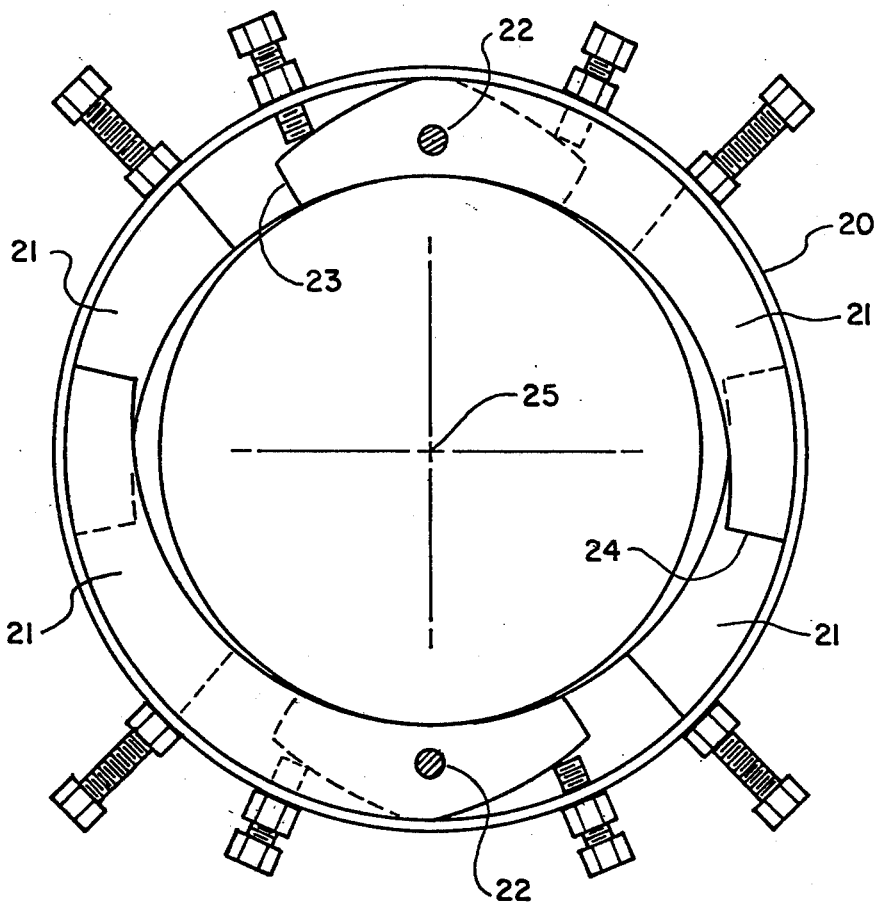
FIG. 2 is an end elevation of a bracket from which plate segments are pivoted to establish the cross-sectional area of a conduit connecting the pulverizer of FIG. 1 to the fuel nozzles in the windboxes of FIG. 1.
Figure 3:
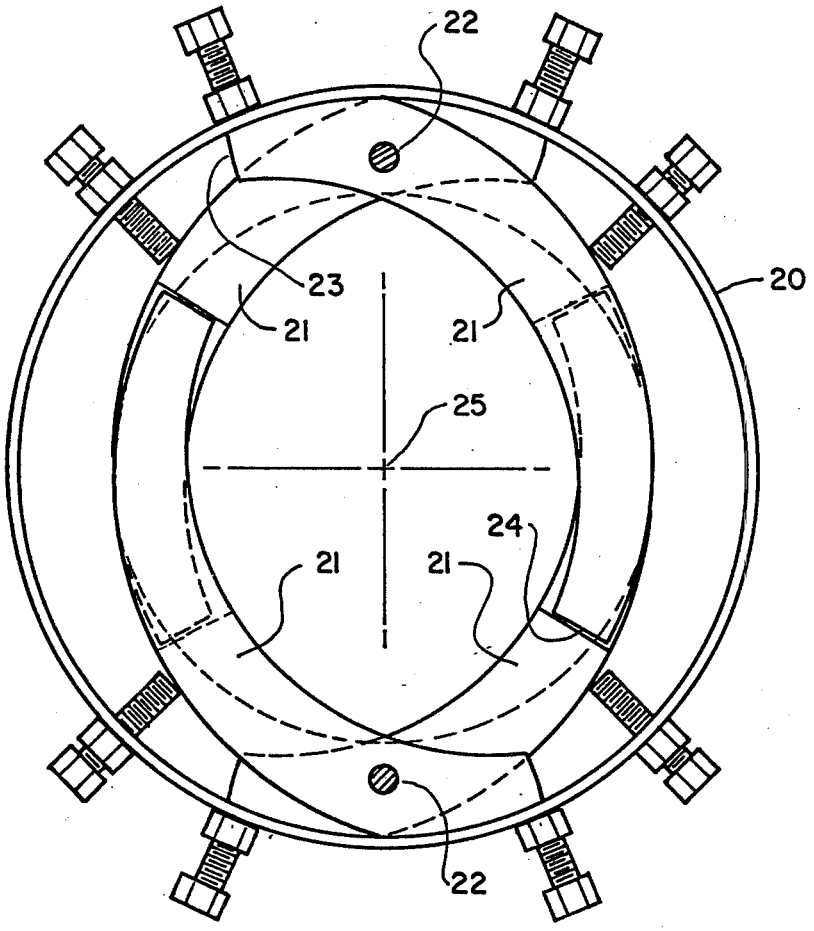
FIG. 3 is the structure of FIG. 2 with the plate segments pivoted inward to reduce the cross-sectional area to a minimum.

In both FIGS. 2 and 3, a bracket 20 is disclosed as adapted to be fastened between two aligned sections of a conduit 4 between the coal pulverizer 1 and a fuel nozzle 5 of a windbox 3. The problem of fastening bracket 20 between the flanged ends of the conduit sections is a separate problem which is assumed to be solved prior to this disclosure. However shaped and arranged to be fastened in a hermetic seal to the conduit sections, bracket 20 is here disclosed as a mount for movable plate segments which can be moved inward, toward the axis of the conduit and form an orifice restriction to the flow of pulverized coal as entrained in air.

FIG. 2 discloses the plurality of plate segments 21 pivoted to their outward extreme position within their range of movement. FIG. 3 discloses the same segments 21 moved inward to the extreme position of their range of movement in providing their maximum restriction to the flow of air-entrained pulverized coal through the conduit.

Each plate segment 21 is formed in an arc. For the purposes of the present disclosure, the degree of this arc has no particular limits. Each of the plurality of segments 21 are pivoted about 22, closer to end 23 than end 24. With the pivot on bracket 20, the segment is thus pivoted eccentrically over a range of movement toward and away from the axis 25 of the conduit and bracket. In FIG. 2, these segments are pivoted outward of axis 25 to provide the minimum of restriction to the coal/air flow through the conduit.

Bracket 20 provides slots oriented transverse to axis 25 in which the segments 21 move about their pivots. Each segment 21 has the major portion of its body pivoted under the force of two screws 26 and 27. To position the major portion of each segment 21 transverse the axis of the conduit, one screw mounted on bracket 20 is advanced, while the other screw is retracted. As illustrated in FIGS. 2 and 3, to advance segment 21 into the conduit, screw 26 is advanced to bear upon the back side of segment 21, while screw 27 is retracted. When the new position of segment 21 is gained, both screws 26 and 27 may be tightened to lock the segment rigidly at its new position. It now should be obvious that to withdraw the segment 21, the screws 26 and 27 are reversed in their direction so that screw 27 will bear upon the back side of segments 21 and force the segment to pivot about 22 to withdraw the main body of the segment away from the axis of the conduit. With this arrangement, the furnace operator can make the desired adjustment externally to establish the amount of all segments moved toward the axis 25.

FIG. 3 discloses each of the plate segments 20 pivoted inward as far as they will go in providing the maximum restriction to coal/air flow. The resulting orifice opening may not be as symmetrical as theoretically desired for an orifice, but it is perfectly adequate to regulate the rate of flow of airentrained pulverized coal from pulverizer 1 to the windboxes 3 of furnace 2. In formulation, a plurality of plate segments are eccentrically pivoted by external adjustments to form an orifice. Formed of silicon carbide, the plate segments provide the optimum resistance available to abrasion, while providing heretofore unattainable flexibility in tuning the plurality of flows to the plurality of windboxes in a tangentially-fired furnace.

From the foregoing, it will be seen that this invention is one well adapted to attain all of the ends and objects hereinabove set forth, together with other advantages which are obvious and inherent to the method and apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. In a system for controlling the air-entrained coal flowing from a pulverizer to each fuel nozzle mounted within a windbox of a tangentially-fired furnace, including.

a conduit connected between the pulverizer and fuel nozzles mounted in each windbox, a bracket mounted between two sections of the conduit, a plurality of abrasion-resistant plate segments and each having a configuration of an arc and pivoted eccentrically from the bracket toward and away from the axis of the conduit.

and screws operative from external the conduit and mounted in threaded engagement with the bracket and each screw bears upon the edge of a plate segment to determine its pivoting toward or away from the axis of the conduit in establishing an orifice-like pressure drop developing restrictions to air-entrained coal flowing through the conduit so as to provide a means for selective control of the flow through the conduit.

* * * * *